US009259057B2

(12) United States Patent
Gerber

(10) Patent No.: US 9,259,057 B2
(45) Date of Patent: Feb. 16, 2016

(54) ARTICLE OF FOOTWEAR WITH INTERLOCKING CLEAT MEMBER AND RAISED BASE

(71) Applicant: NIKE, Inc., Beaverton, OR (US)

(72) Inventor: Clifford B. Gerber, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/697,771

(22) Filed: Apr. 28, 2015

(65) Prior Publication Data

US 2015/0237965 A1 Aug. 27, 2015

Related U.S. Application Data

(60) Continuation of application No. 14/510,590, filed on Oct. 9, 2014, now Pat. No. 9,044,069, which is a division of application No. 13/197,021, filed on Aug. 3, 2011, now Pat. No. 8,898,935.

(51) Int. Cl.
*A43C 15/02* (2006.01)
*A43C 15/16* (2006.01)
(Continued)

(52) U.S. Cl.
CPC ..... *A43C 15/161* (2013.01); *A43B 5/02* (2013.01); *A43B 13/22* (2013.01); *A43C 15/164* (2013.01); *A43C 15/168* (2013.01); *A43C 15/167* (2013.01)

(58) Field of Classification Search
CPC .. A43C 15/161; A43C 15/164; A43C 15/167; A43C 15/168; A43B 13/22; A43B 5/02
USPC ..... 12/142 P; 36/134, 67 D
See application file for complete search history.

(56) References Cited

U.S. PATENT DOCUMENTS 1,768,426 A 6/1930 Stelzer
1,799,334 A 4/1931 Tubbs
(Continued)

FOREIGN PATENT DOCUMENTS

DE 2542116 A1 3/1977
DE 2801983 A1 7/1979
(Continued)

OTHER PUBLICATIONS

International Preliminary Report on Patentability (including Written Opinion of the ISA) inInternational Application No. PCT/US2012/048951, mailed on Feb. 13, 2014.
(Continued)

*Primary Examiner* — Ted Kavanaugh
(74) *Attorney, Agent, or Firm* — Plumsea Law Group, LLC

(57) ABSTRACT

A cleat member for an article of footwear is configured to associate with a raised base on a sole of the article of footwear. The raised base includes an angled face with a plurality of protruding portions extending outwards from the angled face. An underside of the cleat member has an indentation that corresponds to the angled face of the raised base. A plurality of recessed portions are disposed along the indentation on the underside of the cleat member and are configured to associate with the plurality of protruding portions on the angled face of the raised base. The plurality of recessed portions and the plurality of protruding portions have coincident shapes so that the protruding portions fit with the recessed portions. With this configuration, the cleat member and sole are configured with an interlocking arrangement that resists loosening when the article of footwear is used on a ground surface.

20 Claims, 7 Drawing Sheets

(51) Int. Cl.
*A43B 5/02* (2006.01)
*A43B 13/22* (2006.01)

(56) References Cited

U.S. PATENT DOCUMENTS

| | | | | | |
|---|---|---|---|---|---|
| 1,809,194 | A | | 6/1931 | West | |
| 2,276,887 | A | | 3/1942 | Smith | |
| 2,506,801 | A | | 5/1950 | MacNeill | |
| 2,523,652 | A | * | 9/1950 | Dowd | A43C 15/161 36/59 R |
| 3,911,600 | A | | 10/1975 | Dassler | |
| 4,633,600 | A | | 1/1987 | Dassler et al. | |
| 4,648,187 | A | | 3/1987 | Dassler et al. | |
| 4,712,318 | A | * | 12/1987 | Greiner | A43C 15/161 36/134 |
| 5,123,184 | A | | 6/1992 | Ferreira | |
| 5,321,901 | A | | 6/1994 | Kelly | |
| 5,524,367 | A | * | 6/1996 | Ferreira | A43C 15/161 36/134 |
| 6,012,239 | A | | 1/2000 | Conway et al. | |
| 6,463,682 | B1 | | 10/2002 | Carroll, Jr. | |
| D482,853 | S | | 12/2003 | Peabody | |
| 6,708,428 | B2 | | 3/2004 | Chen | |
| 7,007,413 | B2 | | 3/2006 | McMullin | |
| 7,891,118 | B2 | | 2/2011 | Chen et al. | |
| 8,898,935 | B2 | | 12/2014 | Gerber | |
| 2002/0152643 | A1 | | 10/2002 | Kim | |
| 2006/0005431 | A1 | | 1/2006 | Savoie | |
| 2009/0293317 | A1 | | 12/2009 | Krikorian | |
| 2015/0089845 | A1 | | 4/2015 | Gerber | |

FOREIGN PATENT DOCUMENTS

| | | | |
|---|---|---|---|
| EP | 0360202 | A1 | 3/1990 |
| EP | 1728448 | A1 | 12/2006 |
| EP | 1834536 | A1 | 9/2007 |
| GB | 2238098 | A | 5/1991 |
| WO | 2010118329 | A1 | 10/2010 |

OTHER PUBLICATIONS

International Search Report and Written Opinion for Application No. PCT/US2012/048951, mailed Jan. 22, 2013.

* cited by examiner

ARTICLE OF FOOTWEAR WITH INTERLOCKING CLEAT MEMBER AND RAISED BASE

CROSS-REFERENCE TO RELATED APPLICATIONS

This application is a continuation of U.S. patent application Ser. No. 14/510,590, filed on Oct. 9, 2014 and entitled "Article Of Footwear With Interlocking Cleat Member and Raised Base", which application is a division of U.S. patent application Ser. No. 13/197,021, filed on Aug. 3, 2011 and entitled "Article Of Footwear With Interlocking Cleat Member and Raised Base", issued as U.S. Pat. No. 8,898,935 on Dec. 2, 2014, the disclosures of which applications are entirely incorporated herein by reference.

BACKGROUND

The present invention relates to an article of footwear, and in particular to an article of footwear with a cleat member and a raised base with an interlocking arrangement.

Articles of footwear with interchangeable or removable cleats configured to be worn for athletic activities have been previously proposed. In particular, mechanisms for securing the cleats to the article of footwear to prevent accidental loosening have also been previously proposed.

Stelzer (U.S. Pat. No. 1,768,426) is directed to a calk or cleat for football shoes. Stelzer teaches that the end face of a cylindrical holding body and the bottom of an annual groove on the cleat have flutes or teeth that engage with one another to give security against accidental loosening.

Tubbs (U.S. Pat. No. 1,799,334) is directed to a shoe cleat. Tubbs teaches a cleat that is screwed into a base portion on a shoe sole. Tubbs discloses recesses disposed on an end of the cleat that abut and tightly impinge the face of the sole to hold the cleat in position.

Smith (U.S. Pat. No. 2,276,887) is directed to a cleated athletic shoe. Smith discloses a molded conical cleat with beveled or inclined serrations or teeth arranged in a pinwheel or ratchet like formation around an axial bore. Smith also teaches a disc shaped member that is interposed next to the cleat and is provided with serrations similar to the serrations of the cleat.

There exists a need in the art for a cleat member for an article of footwear that provides resistance to accidental loosening when the article of footwear is worn.

SUMMARY

In one aspect, the invention provides a sole for an article of footwear, the sole comprising: at least one raised base disposed in the sole, the raised base including a fastener receiving portion and an angled face; the angled face including a plurality of protruding portions extending out from the angled face; at least one cleat member including a fastening portion configured to associate with the fastener receiving portion of said at least one raised base; the cleat member further including an indentation along an underside of the cleat member, the indentation including a plurality of recessed portions extending into the cleat member; and wherein the plurality of protruding portions are configured to fit within the plurality of recessed portions.

In another aspect the invention provides an article of footwear, the article of footwear comprising: an upper; a sole, the sole further comprising: a plurality of raised bases disposed in the sole, each raised base including a fastener receiving portion and an angled face; the angled face including a plurality of protruding portions extending out from the angled face; a plurality of cleat members, each cleat member including a fastening portion configured to associate with the fastener receiving portion of one of the plurality of raised bases; each cleat member further including an indentation along an underside of the cleat member, the indentation including a plurality of recessed portions extending into the cleat member; and wherein the plurality of protruding portions are configured to fit within the plurality of recessed portions.

In another aspect, the invention provides a cleat member for an article of footwear, the cleat member comprising: a fastening portion, the fastening portion configured to be associated with a fastener receiving portion disposed on a raised based on a sole of the article of footwear; an indentation disposed along an underside of the cleat member, the indentation configured to correspond to the angled face of the raised base; a plurality of recessed portions disposed with the indentation, the plurality of recessed portions configured to associate with a plurality of protruding portions disposed on the angled face of the raised based; and wherein the plurality of protruding portions are configured to fit within the plurality of recessed portions.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
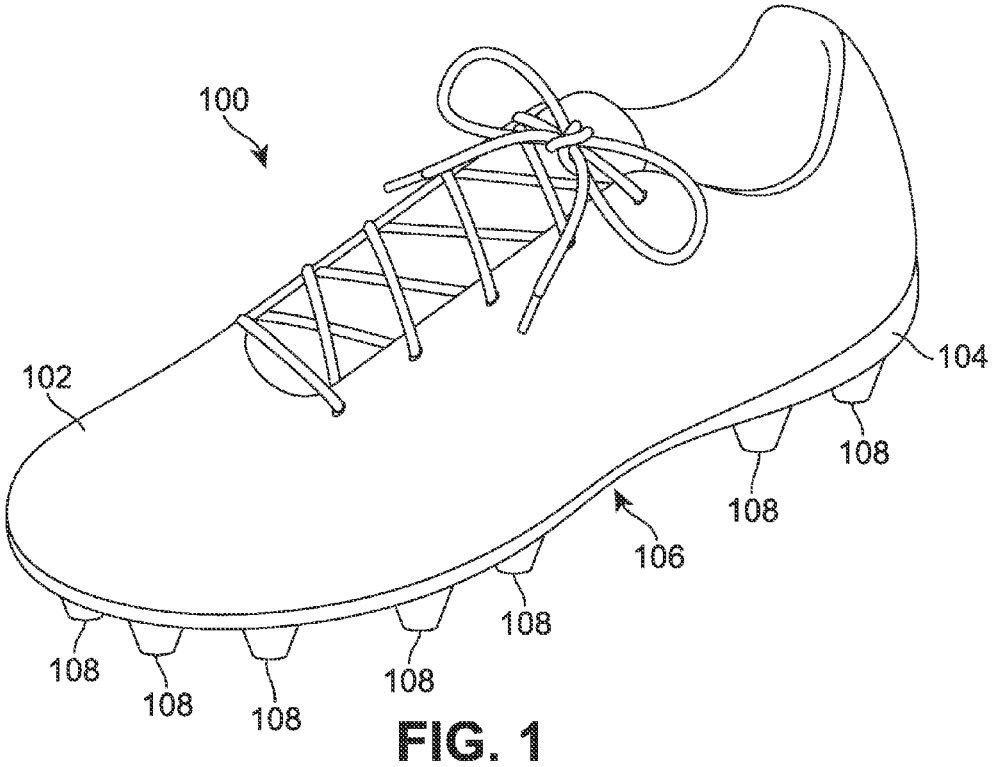
FIG. 1 is an isometric view of an exemplary embodiment of an article of footwear configured with cleat members.

FIG. 1 illustrates an exemplary embodiment of article of footwear 100. For clarity, the following detailed description discusses an exemplary embodiment, in the form of a football shoe, but it should be noted that the present invention could take the form of any article of footwear including, but not limited to, soccer shoes, rugby shoes, baseball shoes as well as other kinds of shoes. As shown in FIG. 1, article of footwear 100, also referred to as simply article 100, is intended to be used with a left foot, however it should be understood that the following discussion may equally apply to a mirror image of article of footwear 100 that is intended for use with a right foot.

In some embodiments, article of footwear 100 may include one or more components. In an exemplary embodiment, article 100 may include an upper 102. For clarity, only a portion of upper 102 is shown in FIG. 1. Upper 102 may be configured to receive a wearer's foot. Generally, upper 102 may be any type of upper. In particular, upper 102 could have any design, shape, size and/or color. For purposes of illustration, upper 102 is shown generically in this embodiment.

In an exemplary embodiment, article of footwear 100 may also include sole 104. In some embodiments, sole 104 may include a bottom surface 106 and a top surface (not shown) disposed on an opposite side of sole 104 than bottom surface 106. In an exemplary embodiment, the top surface may be associated with a foot and is configured to contact a portion of upper 102, a midsole, and/or an insole of article 100. In some embodiments, bottom surface 104 may be configured to contact a ground surface, including, but not limited to dirt, natural grass, synthetic grass or turf, as well as other types of playing surfaces.

Generally, each component of article of footwear 100 may be constructed of any material. One or more portions of sole 104 may be constructed from any suitable material, including but not limited to elastomers, siloxanes, natural rubber, other synthetic rubbers, aluminum, steel, natural leather, synthetic leather, or plastics. Also, upper 102 may be made from any suitable material, including but not limited to, for example, nylon, natural leather, synthetic leather, natural rubber, or synthetic rubber.

In an exemplary embodiment, sole 104 may include provisions for increasing traction with a ground surface. In some cases, sole 104 may include one or more cleat members 108 to enhance traction with the ground. Generally, the term "cleat members" as used in this detailed description and throughout the claims includes any provisions disposed on a sole for increasing traction through friction and/or penetration of a ground surface. Typically, cleat members may be configured for particular uses, including, but not limited to football, soccer, baseball or any type of activity that requires traction. In this embodiment, sole 104 may be associated with a plurality of cleat members 108. In an exemplary embodiment, plurality of cleat members 108 may be disposed through one or more regions of article 100, including one or more of a forefoot region, a mid-foot region, and/or a heel region.

Generally, plurality of cleat members 108 may be associated with sole 104 in any manner. In some embodiments, plurality of cleat members 108 may be removably attached to sole 104 using fasteners that are configured to be associated with corresponding receiving elements within sole 104. In other embodiments, however, other provisions may be provided to attach one or more of cleat members 108 to sole 104. In still other embodiments, one or more of plurality of cleat members 108 may be integrally formed with sole 104. In an exemplary embodiment, one or more of cleat members 108 may be screwed into fastener receiving portions in bottom surface 106 of sole 104.

Figure 2:
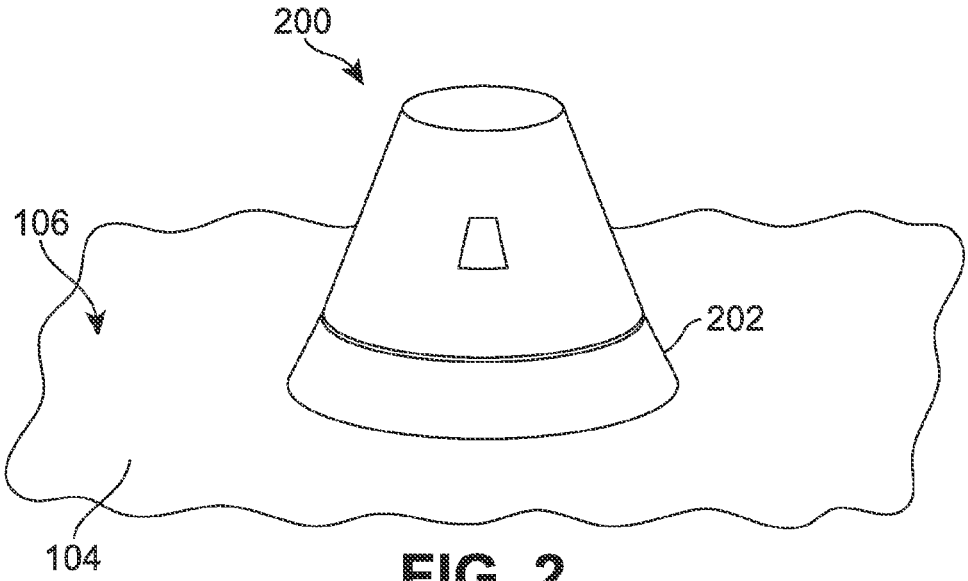
FIG. 2 is an enlarged view of an exemplary embodiment of a cleat member configured to releasably attach to a raised base disposed in a sole of an article of footwear.

Referring now to FIG. 2, a first cleat member 200 is illustrated disposed in bottom surface 106 of sole 104. First cleat member 200 may be representative of one or more cleat members associated with plurality of cleat members 108. In this embodiment, first cleat member 200 may be screwed into a platform 202 disposed on bottom surface 106 of sole 104. In some embodiments, platform 202 may be provided to raise a cleat member further above bottom surface 106 of sole 104. In some cases, platform 202 may be formed integral with sole 104. In other cases, platform 202 may be separately formed alone or as part of a separate component. In still other cases, platform 202 may be configured to be associated with more than one cleat member. While in the embodiments described herein, platform 202 is illustrated, in other embodiments, however, platform 202 is optional and may be omitted.

Figure 3:
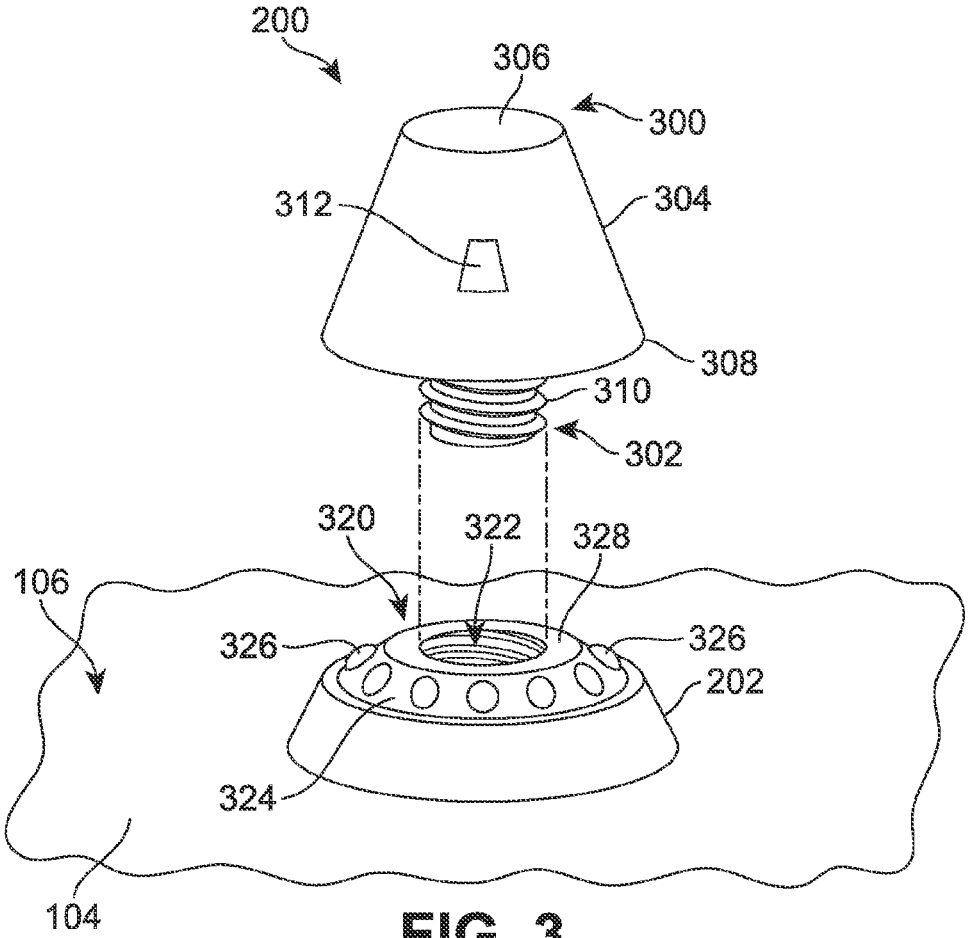
FIG. 3 is an exploded view of an exemplary embodiment of a cleat member configured to releasably attach to a raised base disposed in a sole of an article of footwear.

FIG. 3 illustrates an exploded view of an exemplary embodiment of first cleat member 200. In this embodiment, first cleat member 200 is configured to releasably attach to a fastener receiving portion 322 disposed within a raised base 320 on bottom surface 106 of sole 104. While FIG. 3 illustrates the attachment of first cleat member 200 to fastener receiving portion 322, it should be understood that the remaining members of plurality of cleat members 108 may be attached in a substantially similar manner to additional fastener receiving portions disposed within additional raised bases on bottom surface 106 of sole 104. In addition, as discussed above, in this embodiment, raised base 320 is located on top of platform 202. However, in other embodiments, raised base 320 may be disposed directly on bottom surface 106.

In this embodiment, first cleat member 200 includes a distal end 300 and a proximal end 302. Distal end 300 is disposed at a portion of first cleat member 200 that is located further from bottom surface 106 of sole 104. Similarly, proximal end 302 is disposed at a portion of first cleat member 200 that is located closer to bottom surface 106 of sole 104. In an exemplary embodiment, first cleat member 200 may include a body 304. In this embodiment, body 304 may have a generally truncated conical shape. In other embodiments, body 304 may have other shapes. In this embodiment, first cleat member 200 includes a ground-engaging portion 306 that is disposed at distal end 300 of first cleat member 200. Ground-engaging portion 306 of first cleat member 200 may be configured to contact and/or penetrate a ground surface.

In some embodiments, first cleat member 200 may include a lip 308. In this embodiment, lip 308 may be a portion of body 304 disposed adjacent to proximal end 302. In an exemplary embodiment, lip 308 may define an outer periphery of body 304 of first cleat member 200. In cases where body 304 has a generally truncated conical shape, lip 308 may be associated with the wider portion of body 304 and ground-engaging portion 306 may be associated with the narrower portion of body 304.

In some embodiments, body 304 may be configured with additional provisions for engaging a tool that may attach first cleat member 200 to an article of footwear. In some cases, body 304 may include one or more grasping portions. Generally, the grasping portions may be recesses disposed on body 304. In this embodiment, grasping portion 312 may be disposed on body 304. In some embodiments, body 304 may be configured with multiple grasping portions that are substantially similar to grasping portion 312. In one embodiment, first cleat member 200 may include three grasping portions, including grasping portion 312, disposed in an approximately evenly-spaced configuration around body 304. In other embodiments, a cleat member may include more or fewer grasping portions, which may be spaced evenly or unevenly around the body of the cleat member. In an exemplary embodiment, grasping portion 312 may have a generally triangular shape. With this arrangement, grasping portion 312 may engage a tool to secure first cleat member 200 to sole 104 of an article.

Generally, grasping portions may have any size and shape. Examples of various shapes include, but are not limited to, squares, rectangles, circles, ovals, polygonal and irregular shapes, as well as any other type of shape. Additionally, the depth of grasping portions can vary. By using different shapes recessed with different depths, grasping portions may be configured to engage a tool to attach a cleat member to an article of footwear.

In this embodiment, first cleat member 200 includes a fastening portion 310. In an exemplary embodiment, fastening portion 310 may protrude outward from body 304 at proximal end 302. In this embodiment, fastening portion 310 may be disposed below lip 308 of body 304. With this arrangement, fastening portion 310 may be configured to releasably attach first cleat member 200 to fastener receiving portion 322 disposed within raised base 320 on bottom surface 106 of sole 104.

Generally, fastening portion 310 may be configured in any manner to engage fastener receiving portion 322. In particular, fastening portion 310 may be configured with a diameter sufficient to engage and fit within fastener receiving portion 322. In some embodiments, fastening portion 310 may include some type of threading to engage fastener receiving portion 322. Additionally, fastener receiving portion 322 may include grooves configured to receive the threading on fastening portion 310. In an exemplary embodiment, fastening portion 310 may include a conventional pipe thread. In other embodiments, fastening portion 310 may be associated with any type of thread, including threads having various sizes and pitch diameters. With this arrangement, fastening portion 310 may be screwed into fastener receiving portion 322.

Generally, a sole may have any number of fastener receiving portions to receive any number of cleat members. In some embodiments, each of the cleat members comprising plurality of cleat members 108 shown in FIG. 1 may be associated with a fastener receiving portion on sole 104. In addition, fastener receiving portions on a sole may be arranged in any particular design or pattern on any portion of a sole. Particular configurations of fastener receiving portions and associated cleat members may be associated with different sports or different player positions within a sport. In the embodiment illustrated in FIG. 1, plurality of cleat members 108 are releasably attached to fastener receiving portions disposed on a forefoot region and/or heel region of sole 104. However, in other embodiments, fastener receiving portions may be disposed in alternative patterns. For example, in an alternative embodiment, fastener receiving portions may be disposed on one or more of a forefoot region, midfoot region, and/or heel region of a sole. With this alternative arrangement, cleat members may be provided on different regions of sole 104 to allow for increased traction at those regions.

In some embodiments, fastener receiving portion 322 may be disposed within raised base 320. In an exemplary embodiment, raised base 320 may be disposed above bottom surface 106 and/or platform 202 of sole 104. In this embodiment, raised base 320 is disposed on platform 202 and extends above platform 202. By extending raised base 320 above bottom surface 106 and/or platform 202, grooves within fastener receiving portion 322 configured to receive the threading on fastening portion 310 may be made longer and allow for a longer fastening portion 310. With this arrangement, cleat member 200 may be more securely attached to sole 104 of article 100.

In some embodiments, an underside of a cleat member may be configured with a particular shape to securely fit against sole 104 when fastening portion 310 is inserted and secured within fastener receiving portion 322. For example, if raised base 320 protrudes from sole 104, the underside of the cleat member may be configured with a concave shape to snugly fit on bottom surface 106 and/or platform of sole 104.

In some embodiments, a raised base may be configured with one or more provisions to engage with a portion of a cleat member. In an exemplary embodiment, raised base 320 may be configured with one or more provisions to engage with a portion of body 304 of first cleat member 200 when first cleat member 200 is attached to sole 104. In one embodiment, raised base 320 may include an angled face 324. In some embodiments, angled face 324 may be a portion of raised base 320 that tapers or slopes from a shank 328 disposed on top of raised base 320 towards the bottom of raised base 320. In an exemplary embodiment, angled face 324 may be associated with an angle of approximately 45 degrees. In other embodiments, angled face 324 may be associated with a greater or smaller angle.

In an exemplary embodiment, angled face 324 of raised base 320 may be configured to fit within a corresponding sloped indentation disposed on an underside of body 304 of first cleat member 200. With this arrangement, first cleat member 200 may fit securely against sole 104 when fastening portion 310 is inserted and secured within fastener receiving portion 322.

In some embodiments, an angled face on a raised base may include one or more components that are configured to provide an interlocking arrangement between a cleat member and the raised base. With an interlocking arrangement, at least a portion of the angled face of the raised base and a portion of the cleat member may include coincident or corresponding shapes that are configured to align when the cleat member is fastened to the sole. By providing an interlocking arrangement, a cleat member may be more securely attached to a sole of an article. In an exemplary embodiment, angled face 324 of raised base 320 may be provided with a plurality of protruding portions 326. In this embodiment, protruding portions 326 are associated with a semi-spherical or dome-shaped protrusion that extends out from angled face 324. Generally, plurality of protruding portions 326 may have any convex shape. In other embodiments, however, protruding portions may be associated with different shapes.

Figure 4:
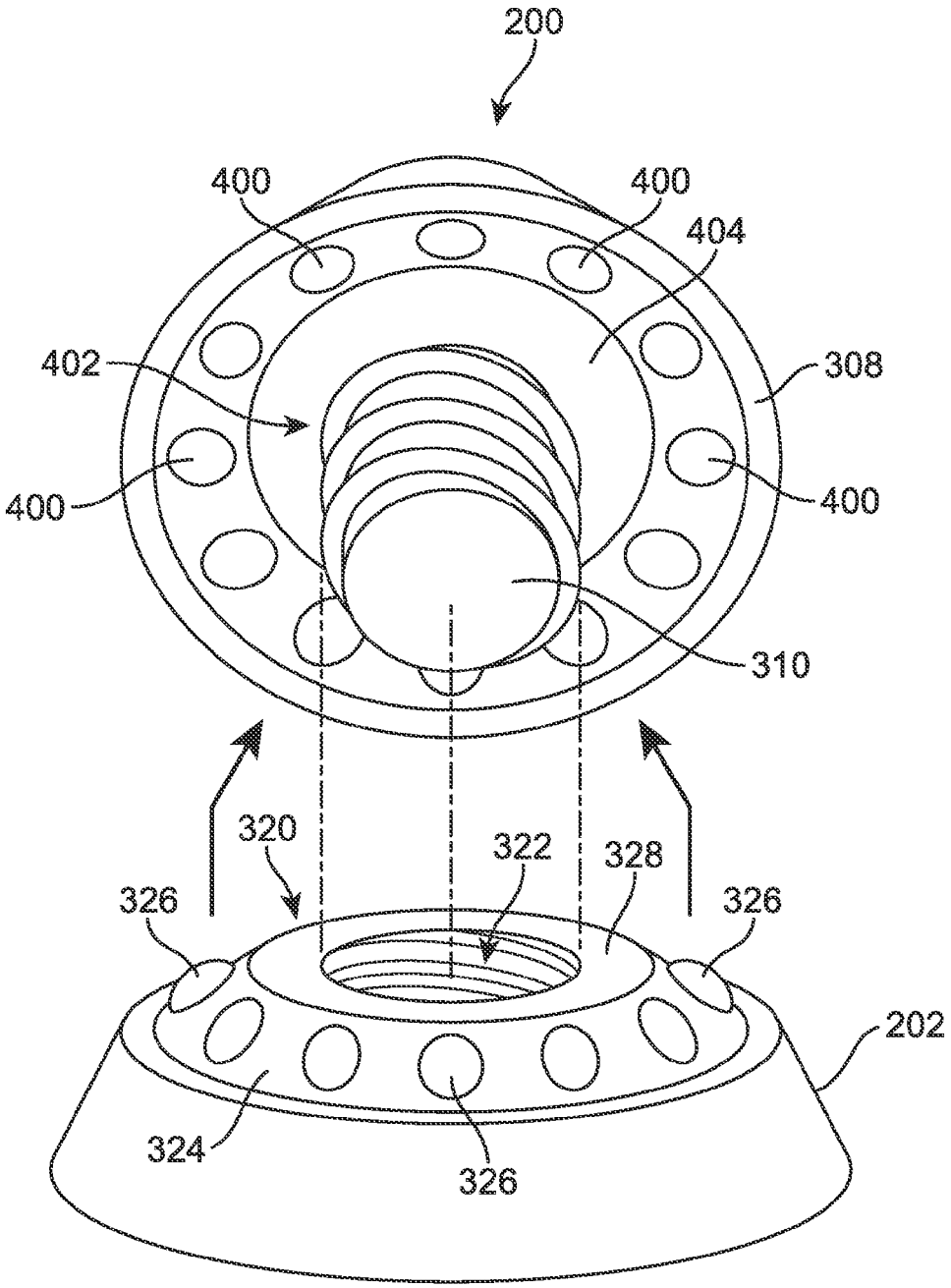
FIG. 4 is a rotated exploded view of an underside of an exemplary embodiment of a cleat member and a raised base configured with an interlocking arrangement.

Referring now to FIG. 4, a rotated exploded view of an underside 402 of first cleat member 200 and raised base 320 configured with an interlocking arrangement is illustrated. In this embodiment, plurality of protruding portions 326 may extend out from angled face 324 of raised base 320. As discussed above, angled face 324 of raised base 320 may be configured to fit within a corresponding indentation 404 disposed on underside 402 of body 304 of first cleat member 200. In an exemplary embodiment, indentation 404 may include a generally flat portion disposed close to fastening portion 310 that is configured to be associated with shank 328 on top of raised base 320. In some embodiments, indentation 404 may further include a sloped portion extending from the generally flat portion to lip 308 of first cleat member 200. In an exemplary embodiment, the sloped portion of indentation may be configured to have an identical or substantially similar angle as angled face 324. With this arrangement, first cleat member 200 may fit securely against sole 104 when fastening portion 310 is inserted and secured within fastener receiving portion 322.

In an exemplary embodiment, first cleat member 200 may include a plurality of recessed portions 400 disposed along the sloped portion of indentation 404 on underside 402. Generally, recessed portions 400 may be configured as hollows or depressions within the sloped portion of indentation 404. In some embodiments, plurality of recessed portions 400 may be configured to engage with one or more of protruding portions 326 extending out from angled face 324 of raised base 320. In an exemplary embodiment, recessed portions 400 and protruding portions 326 may be associated with coincident or corresponding shapes. In this embodiment, recessed portions 400 have a semi-spherical or dome-shaped configuration that corresponds to the shape of protruding portions 326. Generally, plurality of recessed portions 400 may have any concave shape. In other embodiments, however, recessed portions may be associated with different shapes. With this arrangement, plurality of recessed portions 400 and protruding portions 326 may be configured to provide an interlocking arrangement between first cleat member 200 and raised base 320.

Figure 5:
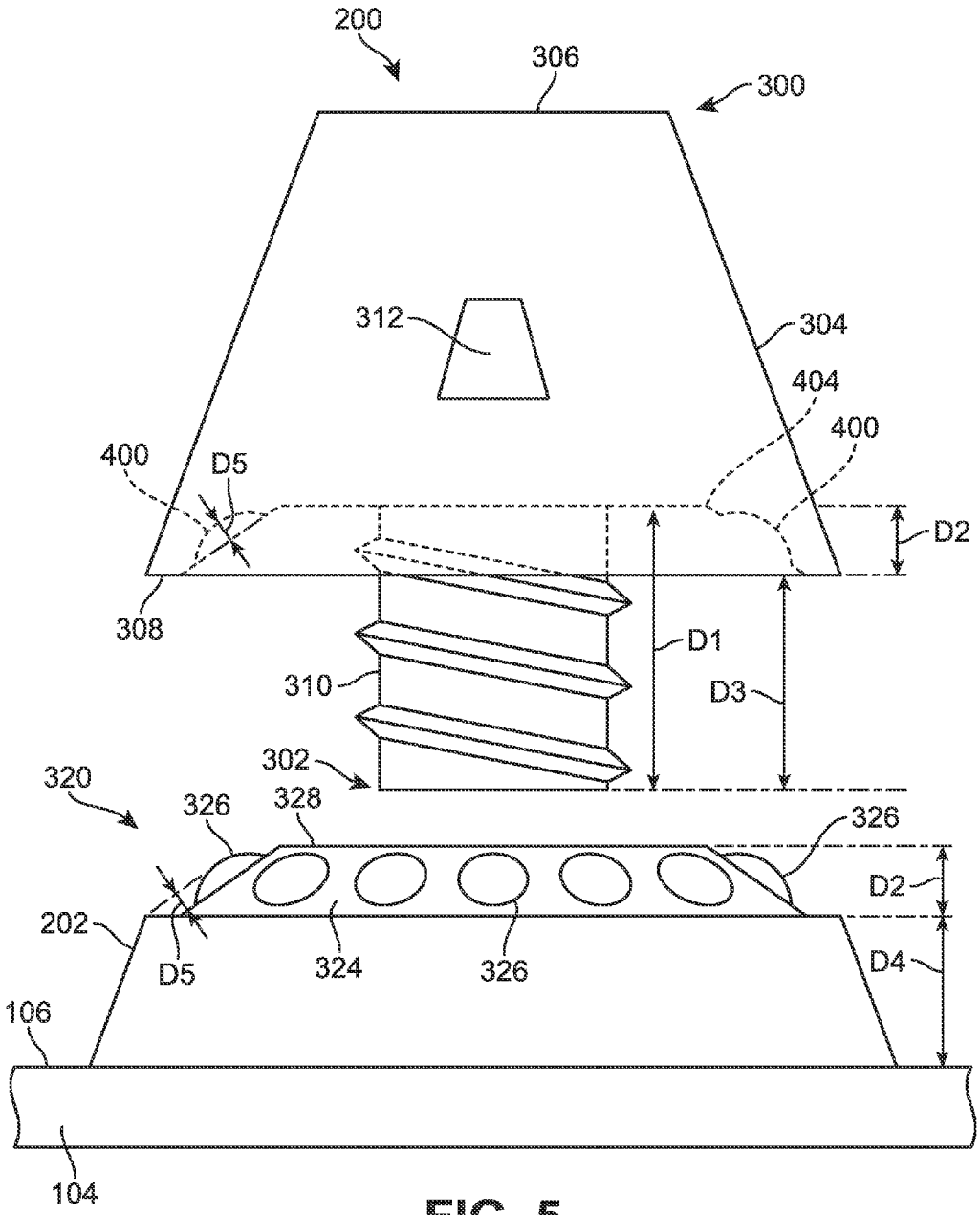
FIG. 5 is a schematic view of an exemplary embodiment of a cleat member and a raised base configured with an interlocking arrangement.

Referring now to FIG. 5, a schematic view of first cleat member 20 and raised base 320 configured with an interlocking arrangement is illustrated. As discussed above, by extending raised base 320 above platform 202 and providing underside 402 of body 304 of first cleat member 200 with a corresponding indentation 404, the length of fastening portion 310 may be made longer. In this embodiment, fastening portion 310 may extend from indentation 404 to proximal end 302 of first cleat member 200. In an exemplary embodiment, fastening portion 310 may be associated with a length extending a first distance D1 between the flat portion of indentation 404 and proximal end 302. As also shown in this embodiment, indentation 404 may be associated with a depth extending a second distance D2 between the flat portion and lip 308 of body 304 of first cleat member 200. With this arrangement, by providing indentation 404 having depth D2 on underside 402 of body 304 of first cleat member 200, the length of fastening portion 310 may be extended beyond a third distance D3 between lip 308 and proximal end 302.

In some embodiments, raised base 320 may be associated with a height extending above platform 202 and/or bottom surface 106 of sole 104. In an exemplary embodiment, the height of raised base 320 may be approximately the same or substantially similar to the depth of indentation 404. In this embodiment, raised base 320 may be associated with a height extending second distance D2 above platform 202. In addition, in some embodiments, platform 202 may be provided to raise the height of a cleat member above bottom surface 106 of sole 104. In this embodiment, platform 202 may be associated with a height extending a fourth distance D4 above bottom surface 106 of sole 104. In some embodiments, additional length may be provided to fastening portion 310 by the depth of indentation 404 and height of raised base 320, as well as the height of platform 202. With this arrangement, the longer fastening portion 310 may be configured to more securely attach first cleat member 200 to sole 104.

In some embodiments, protruding portions 326 on angled face 324 may be associated with a height extending above the surface of angled face 324. In this embodiment, protruding portions 326 may be associated with a height extending a fifth distance D5 above the surface of angled face 324. Similarly, recessed portions 400 on the sloped portion of indentation 404 may be associated with a depth in the surface of the sloped portion on underside 402 of body 304 of first cleat member 200. In an exemplary embodiment, the depth of recessed portions 400 may be identical or substantially similar to the height of protruding portions 326. In this embodiment, recessed portions 400 may be associated with a depth extending fifth distance D5 below the sloped portion of indentation 404. In other embodiments, recessed portions 400 may have a depth that is slightly larger than the height associated with protruding portions 326 to allow for a slight space between recessed portions 400 and protruding portions 326.

Figure 6:
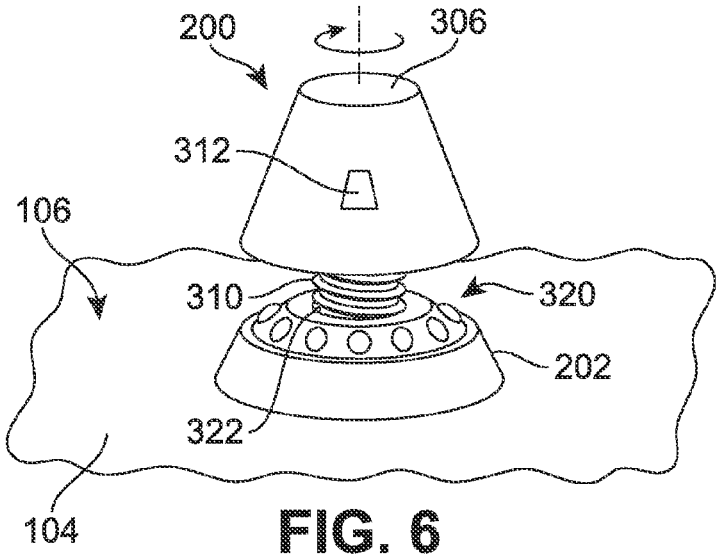
FIG. 6 is a representative view of an exemplary embodiment of a cleat member being releasably attached to a raised base in a sole.

FIGS. 6 through 10 illustrate different views of a cleat member interlocking with a raised base in a sole. Referring now to FIG. 6, in this embodiment, first cleat member 200 is shown being screwed into sole 104 of article 100. In an exemplary embodiment, fastening portion 310 of first cleat member 200 may be aligned with fastener receiving portion 322 on raised base 320. In this embodiment, raised base 320 is disposed on platform 202 above bottom surface 106 of sole 104. As discussed above, in other embodiments, raised base 320 may be disposed directly on bottom surface 106 of sole 104. Once fastening portion 310 and fastener receiving portion 322 have been aligned, first cleat member 200 may be screwed into sole 104. In one embodiment, a tool (not shown) may be used to turn first cleat member 200 and assist with screwing first cleat member 200 into sole 104. In an exemplary embodiment, the tool may turn first cleat member 200 by engaging with one or more grasping portions 312.

Figure 7:
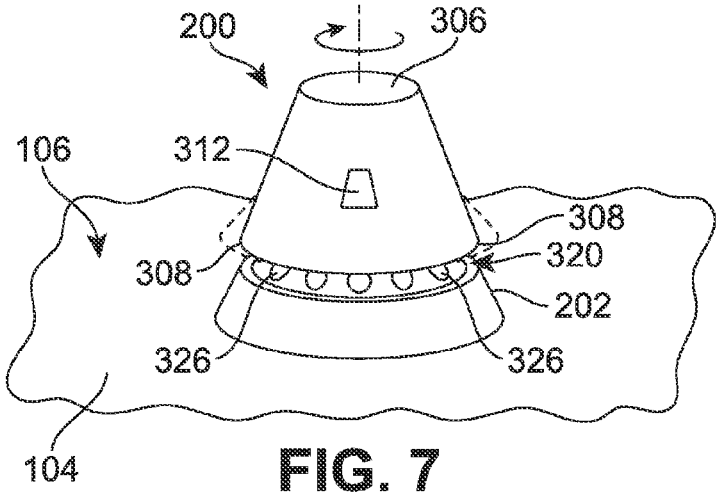
FIG. 7 is a representative view of an exemplary embodiment of a cleat member interlocking with a raised base in a sole.

Referring now to FIG. 7, in this embodiment, as first cleat member 200 is screwed into sole 104, lip 308 of first cleat member 200 approaches protruding portions 326 extending out from angled face 324 on raised base 320. In an exemplary embodiment, as lip 308 engages protruding portions 326, lip 308 flares out slightly around the perimeter of first cleat member 200. As first cleat member 200 continues to be screwed into sole 104, recessed portions 400 on underside 402 of body 304 are moved into alignment with protruding portions 326 disposed on raised base 320. In an exemplary embodiment, when recessed portions 400 are aligned with corresponding protruding portions 326 in an interlocking arrangement, the flared out portion of lip 308 may snap back into position.

In an exemplary embodiment, when first cleat member 200 is sufficiently rotated to bring protruding portions 326 into interlocking alignment with recessed portions 400, the resulting displacement of lip 308 snapping back into position from the flared out position may be felt. With this arrangement, a wearer may receive assurance from the feel of the snap that the cleat members have been securely attached to the article of footwear.

In an exemplary embodiment, lip 308 snapping back into position from the interlocking alignment of protruding portions 326 with recessed portions 400 may create an audible indicia, such as a snapping or clicking sound. In some embodiments, the audible indicia may indicate that the cleat member is interlocked with the sole of the article. With this arrangement, a wearer may receive assurance from the audible indicia that the cleat members have been securely attached to the article of footwear.

Figure 8:
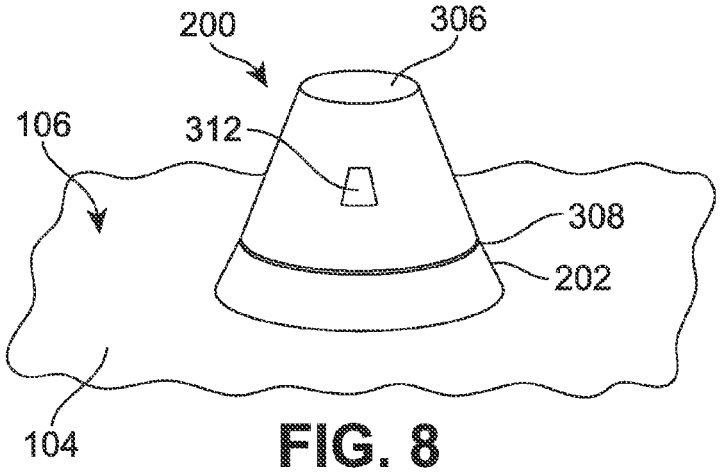
FIG. 8 is a representative view of an exemplary embodiment of a cleat member releasably attached to a raised base with an interlocking arrangement.

Referring now to FIG. 8, first cleat member 200 is shown securely attached to sole 104. In this embodiment, when first cleat member 200 has been fully screwed into sole 104, angled face 324 of raised base 320 extends up into indentation 404 on underside 402 of body 304 of first cleat member 200. In addition, recessed portions 400 on underside 402 of body 304 are aligned with corresponding protruding portions 326 disposed on raised base 320 to form an interlocking arrangement between first cleat member 200 and raised base 320. In an exemplary embodiment, the interlocking arrangement between first cleat member 200 and raised base 320 may more securely attach first cleat member 200 to sole 104. With this arrangement, a cleat member may resist becoming loose while the article of footwear is being worn.

Figure 9:
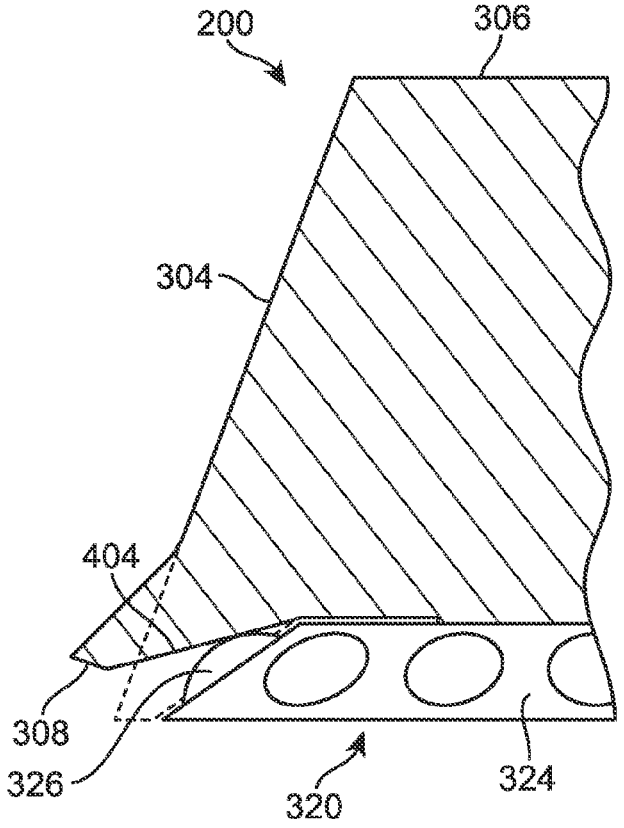
FIG. 9 is a partial cross-sectional view of a cleat member interacting with a protruding portion on a raised base.
Figure 10:
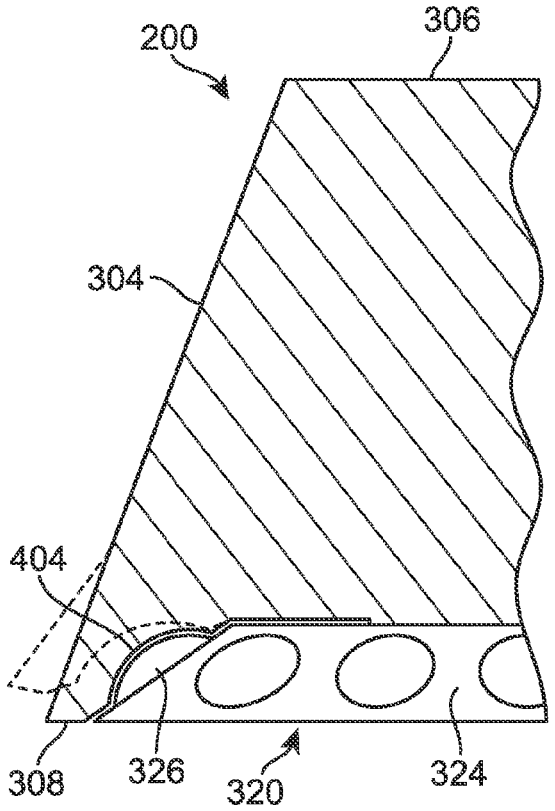
FIG. 10 is a partial cross-sectional view of a recessed portion of a cleat member interlocking with a protruding portion on a raised base.

FIGS. 9 and 10 illustrate detailed views of first cleat member 200 being brought into an interlocking arrangement with raised base 320. Referring now to FIG. 9, when first cleat member 200 is screwed down, indentation 404 on underside 402 of body 304 of first cleat member 200 presses against protruding portions 326 extending out from angled face 324 of raised base 320. In this embodiment, by pressing against indentation 404, protruding portion 326 causes lip 308 to be slightly displaced outward. In an exemplary embodiment, the displacement causes lip 308 to flare out slightly around the perimeter of first cleat member 200.

Referring now to FIG. 10, when first cleat member 200 continues to be turned, recessed portions 400 disposed on indentation 404 on underside 402 of body 304 of first cleat member 200 are brought into alignment with protruding portions 326 disposed on angled face 324 of raised base 320. As shown in FIG. 10, when recessed portions 400 are aligned with corresponding protruding portions 326 in an interlocking arrangement, the flared out portion of lip 308 may snap back into position against angled face 324 of raised base 320.

In an exemplary embodiment, the interlocking arrangement formed by the alignment of recessed portions 400 and protruding portions 326 may assist with securely attaching first cleat member 200 to sole 104. Once recessed portions 400 and protruding portions 326 have been aligned to form the interlocking arrangement, additional force must be applied to cause recessed portions 400 and protruding portions 326 to move out of alignment when first cleat member 200 is unscrewed from sole 104. Until a threshold level of force is applied sufficient to cause lip 308 to flare out and allow recessed portions 400 and protruding portions 326 to move out of alignment, first cleat member 200 may be securely attached to sole 104. With this arrangement, a cleat member may resist becoming loose while the article of footwear is being worn.

Figure 11:
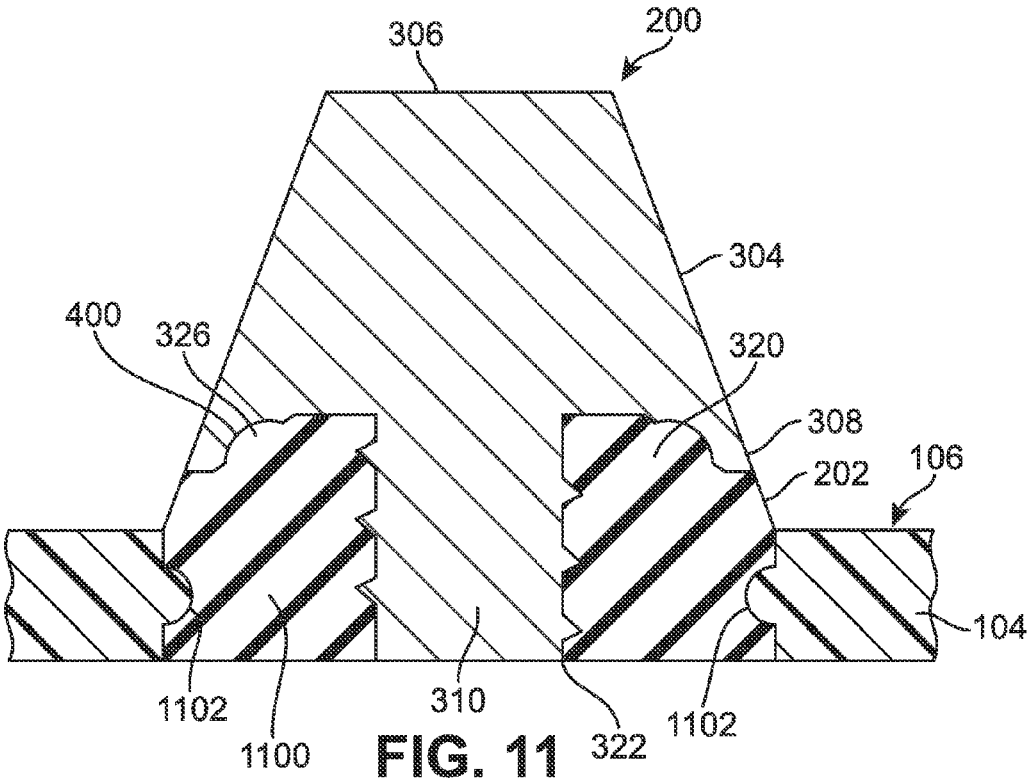
FIG. 11 is a cross-sectional view of an exemplary embodiment of a cleat member and a raised base with an interlocking arrangement.
Figure 12:
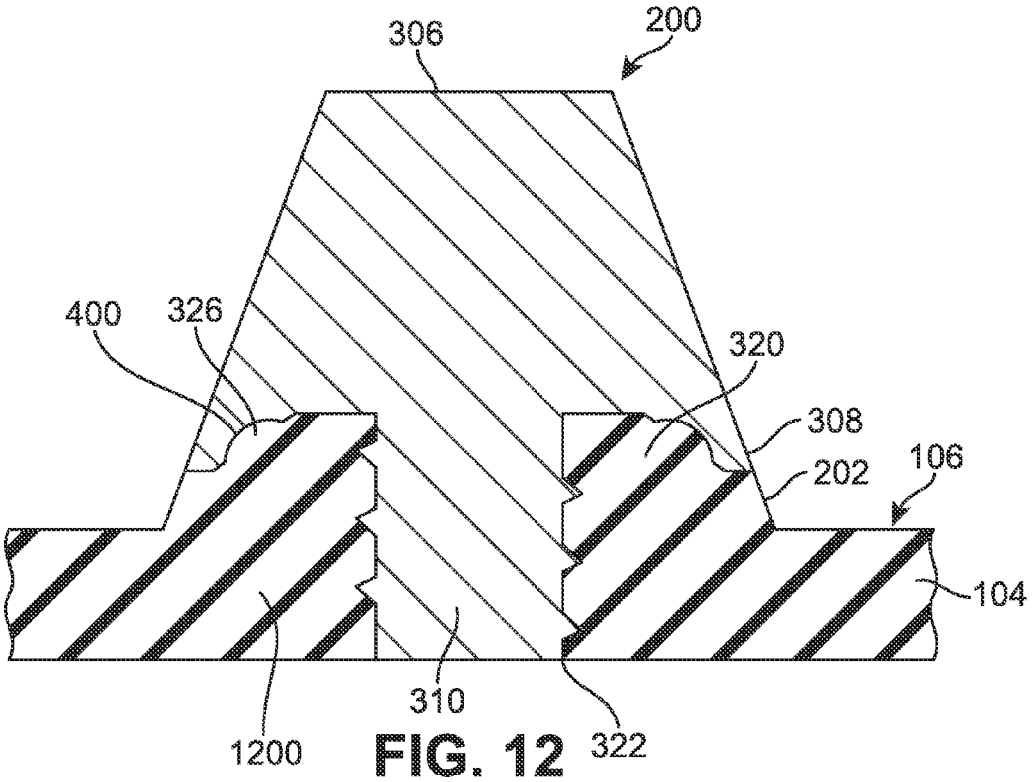
FIG. 12 is a cross-sectional view of an alternate embodiment of a cleat member and a raised base with an interlocking arrangement.

FIGS. 11 and 12 illustrate cross-sectional views of different embodiments of a cleat member and a raised base with an interlocking arrangement. In some embodiments, a raised base may be associated with a platform as a separate component from a sole. Referring now to FIG. 11, in this embodiment, raised base 320 may be associated with platform 202 as a receptacle assembly 1100. In an exemplary embodiment, receptacle assembly 1100 may be a separate component from sole 104. In some embodiments, receptacle assembly 1100 may be made from a different material than the material forming first cleat member 200 and/or sole 104. In one embodiment, receptacle assembly 1100 may be made from a harder material than the material forming first cleat member 200 and/or sole 104.

In some embodiments, receptacle assembly 1100 may include one or more engaging portions 1102. In an exemplary embodiment, engaging portions 1102 on receptacle assembly 1100 may assist with embedding receptacle assembly 1100 within sole 104. In one embodiment, receptacle assembly 1100 may be formed as a separate component and sole 104 may be formed around receptacle assembly 1100. With this arrangement, engaging portions 1102 may be filled with the material forming sole 104, thereby securing receptacle assembly 1100 within sole 104. In this embodiment, receptacle assembly 1100 includes raised base 320 and platform 202. In other embodiments, however, receptacle assembly 1100 may not include platform 202 and the bottom of raised base 320 may be disposed approximately flush or level with bottom surface 106 of sole 104.

In some embodiments, a raised base may be associated with a platform as integral components with a sole. Referring now to FIG. 12, in this embodiment, raised base 320 may be associated with platform 202 as an integrally-formed assembly 1200 with sole 104. In some embodiments, integrally-formed assembly 1200 may be made of substantially the same material as sole 104. In other embodiments, different materials may be used to form integrally-formed assembly 1200. In this embodiment, integrally-formed assembly 1200 includes raised base 320 and platform 202. In other embodiments, however, integrally-formed assembly 1200 may not include platform 202 and the bottom of raised base 320 may be disposed approximately flush or level with bottom surface 106 of sole 104.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of attaching a cleat member to a sole of an article of footwear, the method comprising:

aligning a fastening portion of the cleat member with a fastener receiving portion disposed on a raised base of the sole;

screwing the cleat member into the sole of the article of footwear;

engaging a lip extending around an outer periphery of the cleat member with a plurality of protruding portions disposed on an angled face of the raised base; and aligning a plurality of recessed portions disposed within an indentation disposed along an underside of the cleat member with the plurality of protruding portions disposed on the angled face of the raised base to securely attach the cleat member to the sole of the article of footwear;

wherein the indentation is configured to correspond to the angled face of the raised base and includes: (1) a generally flat portion, and (2) a sloped portion, the sloped portion including the plurality of recessed portions.

2. The method according to claim 1, wherein the step of engaging the lip includes the step of the lip flaring out around a perimeter of the cleat member when contacting the plurality of protruding portions.

3. The method according to claim 2, further comprising snapping the lip back into position when the plurality of recessed portions become aligned with the plurality of protruding portions.

4. The method according to claim 1, wherein the step of aligning the plurality of recessed portions with the plurality of protruding portions forms an interlocking arrangement between the cleat member and the sole.

5. The method according to claim 4, wherein the interlocking arrangement resists becoming loose while the article of footwear is worn.

6. The method according to claim 1, further comprising applying force to the cleat member to move the plurality of recessed portions out of alignment with the plurality of protruding portions and thereby unscrew the cleat member from the sole.

7. The method according to claim 1, further comprising using a tool to screw the cleat member into the sole.

8. The method according to claim 7, wherein the tool is configured to turn the cleat member by engaging with one or more grasping portions disposed on the cleat member.

9. The method according to claim 1, further comprising attaching a plurality of cleat members to the sole of the article of footwear.

10. A method of attaching a cleat member to a sole of an article of footwear, the method comprising:

rotating the cleat member into a raised base on the sole of the article of footwear;

engaging a lip extending around an outer periphery of the cleat member with a plurality of protruding portions disposed on an angled face of the raised base on the sole of the article of footwear;

the lip of the cleat member flaring out from a perimeter of the cleat member when the lip engages the plurality of protruding portions;

rotating the cleat member further to bring a plurality of recessed portions disposed within an indentation along an underside of the cleat member into alignment with the plurality of protruding portions disposed on the angled face of the raised base; and wherein the lip snaps back into position around the outer periphery of the cleat member when the plurality of recessed portions are brought into an interlocking arrangement with the plurality of protruding portions to attach the cleat member to the sole.

11. The method according to claim 10, wherein a displacement of the lip when snapping back into position is configured to be felt.

12. The method according to claim 11, wherein the lip snapping back into position provides assurance that the cleat member is securely attached to the sole of the article of footwear.

13. The method according to claim 10, further comprising an audible indicia associated with the lip snapping back into position.

14. The method according to claim 13, wherein the audible indicia comprises a snapping or clicking sound.

15. The method according to claim 13, wherein the audible indicia provides assurance that the cleat member is securely attached to the sole of the article of footwear.

16. The method according to claim 10, further comprising applying force to the cleat member to move the plurality of recessed portions out of alignment with the plurality of protruding portions and thereby loosen the cleat member from the interlocking arrangement with the sole.

17. The method according to claim 16, wherein the step of applying force to the cleat member causes the lip of the cleat member to flare out from the perimeter of the cleat member when the plurality of recessed portions move out of alignment with the plurality of protruding portions.

18. The method according to claim 17, further comprising unscrewing the cleat member from the sole of the article of footwear.

19. The method according to claim 10, wherein the indentation along the underside of the cleat member is configured to correspond to the angled face of the raised base and includes: (1) a generally flat portion, and (2) a sloped portion, the sloped portion including the plurality of recessed portions.

20. The method according to claim 10, wherein the interlocking arrangement resists becoming loose while the article of footwear is worn.

* * * * *